US009510717B2

(12) United States Patent
Ko

(10) Patent No.: US 9,510,717 B2
(45) Date of Patent: Dec. 6, 2016

(54) SELF-MOVING DUST SUCTION APPARATUS TO FACALITATE CLEANING

(71) Applicant: Joseph Y. Ko, Laguna Niguel, CA (US)

(72) Inventor: Joseph Y. Ko, Laguna Niguel, CA (US)

( * ) Notice: Subject to any disclaimer, the term of this patent is extended or adjusted under 35 U.S.C. 154(b) by 326 days.

(21) Appl. No.: 14/182,999

(22) Filed: Feb. 18, 2014

(65) Prior Publication Data

US 2015/0230678 A1 Aug. 20, 2015

(51) Int. Cl.
*A47L 9/14* (2006.01)
*A47L 9/10* (2006.01)

(52) U.S. Cl.
CPC ..... *A47L 9/106* (2013.01); *A47L 2201/00* (2013.01)

(58) Field of Classification Search
CPC .... A47L 9/1481; A47L 9/106; A47L 2201/00; A47L 9/1691
USPC ..... 15/340.1
See application file for complete search history.

(56) References Cited

U.S. PATENT DOCUMENTS

2005/0217061 A1* 10/2005 Reindle ..... G05D 1/0227 15/319
2012/0169497 A1* 7/2012 Schnittman ..... A47L 9/106 340/540
2012/0199006 A1* 8/2012 Swett ..... A47L 9/106 96/417
2013/0117952 A1* 5/2013 Schnittman ..... A47L 11/34 15/52.1
2014/0026338 A1* 1/2014 Kim ..... A47L 11/4041 15/49.1
2014/0137367 A1* 5/2014 Li ..... A47L 11/4058 15/383
2014/0189977 A1* 7/2014 Wang ..... A47L 9/009 15/347

FOREIGN PATENT DOCUMENTS

TW M407724 U 7/2011
TW M422395 U 2/2012

* cited by examiner

*Primary Examiner* — Joseph J Hail
*Assistant Examiner* — Henry Hong
(74) *Attorney, Agent, or Firm* — Muncy, Geissler, Olds & Lowe, P.C.

(57) ABSTRACT

A self-moving dust suction apparatus to facilitate cleaning comprises a dust suction base, a detachable dust collection unit and an airflow directing element. The dust suction base includes an air drawing mechanism to draw airflow, a housing space corresponding to the air drawing mechanism, an opening communicating with the housing space and a trigger driven mechanism. The detachable dust collection unit is held in the housing space through the opening and includes a dust suction inlet corresponding to the air drawing mechanism. The airflow directing element is disposed on the detachable dust collection unit and includes an elastic barrier plate which partially surrounds the dust suction inlet and extends towards a floor from the detachable dust collection unit to confine direction of the airflow flowing into the dust suction inlet.

9 Claims, 6 Drawing Sheets

SELF-MOVING DUST SUCTION APPARATUS TO FACALITATE CLEANING

FIELD OF THE INVENTION

The present invention relates to a self-moving dust suction apparatus and particularly to a self-moving dust suction apparatus that includes a detachable dust collection unit separable in two stages and can confine direction of airflow sucked into a dust suction inlet to facilitate clean thereof.

BACKGROUND OF THE INVENTION

To maintain environmental neatness and sanitary condition, tools to clear dust and dirt such as brooms, mops or dust suction devices are generally being used. A dust suction device performs clearing by driving an air suction fan to form a negative pressure inside the dust suction device to generate a suction force to suck in dirt, and collects the dirt in a dust suction box inside the device. However, a user needs to drag the conventional dust suction device to allow a dust suction port of the dust suction device to suck the dust on the floor. It takes the user a greater effort and time to drag the dust suction device to finish the clearing task.

With advance of technology, now automatic clearing apparatus capable of providing automatic dust suction function has been developed and marketed. It no longer needs people to drag and control positioning of the dust suction port to suck the dust. The automatic clearing apparatus can automatically move and perform dust suction at the same time, so as to do clearing work without manpower. Once the automatic clearing apparatus is activated by the user it can automatically perform dust suction action in a space where clearing is intended, thus brings the user great convenience while doing the clearing job. However, after the automatic clearing apparatus has performed the dust suction action for a period of time, a lot of dirt is gathered in a dust collection box thereof. The user has to remove the dust collection box to clear the dirt inside the box. But detaching of the conventional dust collection box often is quite complicated and inconvenient, as a result the user often is smeared with the dirt or the dirt in the dust collection box is falling out. Moreover, the automatic clearing apparatus is likely to perform the dust suction action in the cleaned area, so that its dust suction power is wasted.

In order to facilitate users to detach and reassemble the dust collection box and also improve the dust suction efficiency of the automatic cleaning apparatus, a technique aiming for this purpose has been developed. For instance, Taiwan utility model No. M422395 discloses a negative ion cleaning robot which includes a dust suction module and a main body. The dust suction module includes a dust collection box, a negative ion generator, a conductive line, a brush, an air fan, an air outlet, a filter, a bottom lid and an air inlet. The negative ion generator generates negative ions. The air fan generates airflow to suck external dust into the dust collection box. The filter is located in the dust collection box and above the air fan. The air outlet is located at one side of the dust collection box. The bottom lid is located below the air fan and the air outlet and connects to a lateral side of the dust collection box, and includes a grid corresponding to the air outlet to let the negative ions being carried out by the airflow. The air inlet is located at the bottom of the dust suction module. When the air fan is in operation, the external dust is sucked into the dust collection box through the air inlet.

Taiwan utility model No. M407724 also discloses a dust collection box and a dust suction machine adopted the dust suction box. The dust suction machine includes a body which includes a chamber to hold the dust collection box and a pair of latch troughs. The dust collection box can be joined to or detached from the chamber, and includes a holding body and a first latch means. The holding body includes a lid and a box. The first latch means is disposed on the lid and includes a pair of first movable operation members and a first elastic element interposed between the first operation members. Each of the first operation members includes a first latch member, and has a holding position in which the first operation members are pressed by the first elastic element in normal conditions and a release position in which the first elastic element is compressed. At the release position the first latch member is retracted into the lid. At the holding position the first latch member is extended outside the lid. When the dust collection box is assembled with the body, the first latch members are wedged in the pair of latch troughs.

The aforesaid dust collection box and dust suction machine disclose that the first operation members can be clipped by user's fingers and moved inward to the release position, so that the first latch members retract from the latch troughs into the lid and the user can to remove the dust collection box from the dust suction machine. However, the dust collection box has drawbacks such as consisting of a great number of components and its complex structure. Moreover, concerning the negative ion cleaning robot, the dust collection box at the bottom thereof is disposed above the air fan. Hence detaching and reassembly of the dust collection box are inconvenient. In addition, the air inlet of the negative ion cleaning robot is open type that receive dust suction airflow from different directions, including the cleaned area. As a result, the negative ion cleaning robot still has problem of wasting dust suction power.

SUMMARY OF THE INVENTION

The primary object of the present invention is to overcome the problems of detaching and assembly inconvenience and poorer dust suction efficiency that occurred to the conventional automatic cleaning machines.

To achieve the foregoing object the present invention provides a self-moving dust suction apparatus to facilitate cleaning that comprises a dust suction base, a detachable dust collection unit and an airflow directing element. The dust suction base includes an air drawing mechanism to suck airflow, a housing space corresponding to the air drawing mechanism, an opening communicating with the housing space and a trigger driven mechanism. The trigger driven mechanism includes a trigger unit depressible by a user, a latch element driven by the trigger unit to situate at a latch position and a release position, and at least one elastic element to provide a resilient force to make the latch element at the latch position in normal conditions. The detachable dust collection unit is held in the housing space through the opening and includes a dust suction inlet corresponding to the air drawing mechanism and at least one first coupling portion coupled with the latch element at the latch position and separated from the latch element at the release position. The airflow directing element is disposed on the detachable dust collection unit and includes an elastic barrier plate which partially surrounds the dust suction inlet and extends towards a floor from the detachable dust collection unit to confine direction of the airflow flowing into the dust suction inlet.

In one embodiment the dust suction base includes a driving wheel assembly to drive the dust suction base to move along a dust suction direction.

In another embodiment the dust suction base includes an auxiliary driven wheel driven by the driving wheel assembly.

In yet another embodiment the dust suction base includes a control unit electrically connected to the air drawing mechanism and driving wheel assembly.

In yet another embodiment the elastic barrier plate partially surrounds the dust suction inlet at one side opposite to the dust suction direction.

In yet another embodiment the elastic barrier plate includes a sway movement to sway away from the dust suction direction upon being in contact with an obstacle on the floor.

In yet another embodiment the air drawing mechanism includes a first driving motor and an air fan driven by the first driving motor.

In yet another embodiment the trigger unit includes a button located on the dust suction base and depressible by the user and a fastening element hinged on the dust suction base and triggered by the button to move the latch element to a latch position and a release position.

In yet another embodiment the detachable dust collection unit includes a holding surface, at least one holding wall extended from the holding surface and a holding portion surrounded by the holding wall.

In yet another embodiment the detachable dust collection unit includes a protruding portion jutting from the holding surface toward the holding portion in the dust suction inlet and a guiding portion surrounded the dust suction inlet and extended towards the boss.

In yet another embodiment the elastic barrier plate is extended towards the floor and spaced from it at a distance ranged from 0.5 mm and 10 mm.

In yet another embodiment the dust suction base includes a fastening portion, and the detachable dust collection unit includes a second latch portion latched on the fastening portion.

The invention, by means of the structure set forth above, compared with the conventional structures, provides many advantageous features, notably:

1. Through the airflow directing element direction of the sucked airflow passing through the dust suction inlet can be confined as desired. The airflow directing element partially surrounds the guiding portion and is disposed at the rear side of the dust suction inlet so that dust suction area is shrunk to enhance a pressure difference and converge the suction airflow, thereby the dust suction apparatus has greater dust suction power.

2. Through the trigger unit, the latch element and the first elastic element of the trigger driven mechanism, the detachable dust collection unit can be detached from and reassembled with the dust suction base. The trigger driven mechanism is a simplified structure for detaching and assembly of the detachable dust collection unit.

3. The detachable dust collection unit can be latched on the dust suction apparatus through the latch element and the fastening portion. When removing the detachable dust collection unit is desired, the user can press the trigger driven mechanism to separate the detachable dust collection unit and the latch element, which is called a first separation step; then disengaging the detachable dust collection unit from the fastening portion, which is called a second separation step. This two-step separation process can prevent the dirt from scattering around during assembly and detaching of the detachable dust collection unit.

4. The detachable dust collection unit is located at the bottom of the apparatus, hence can be directly detached to facilitate cleaning.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
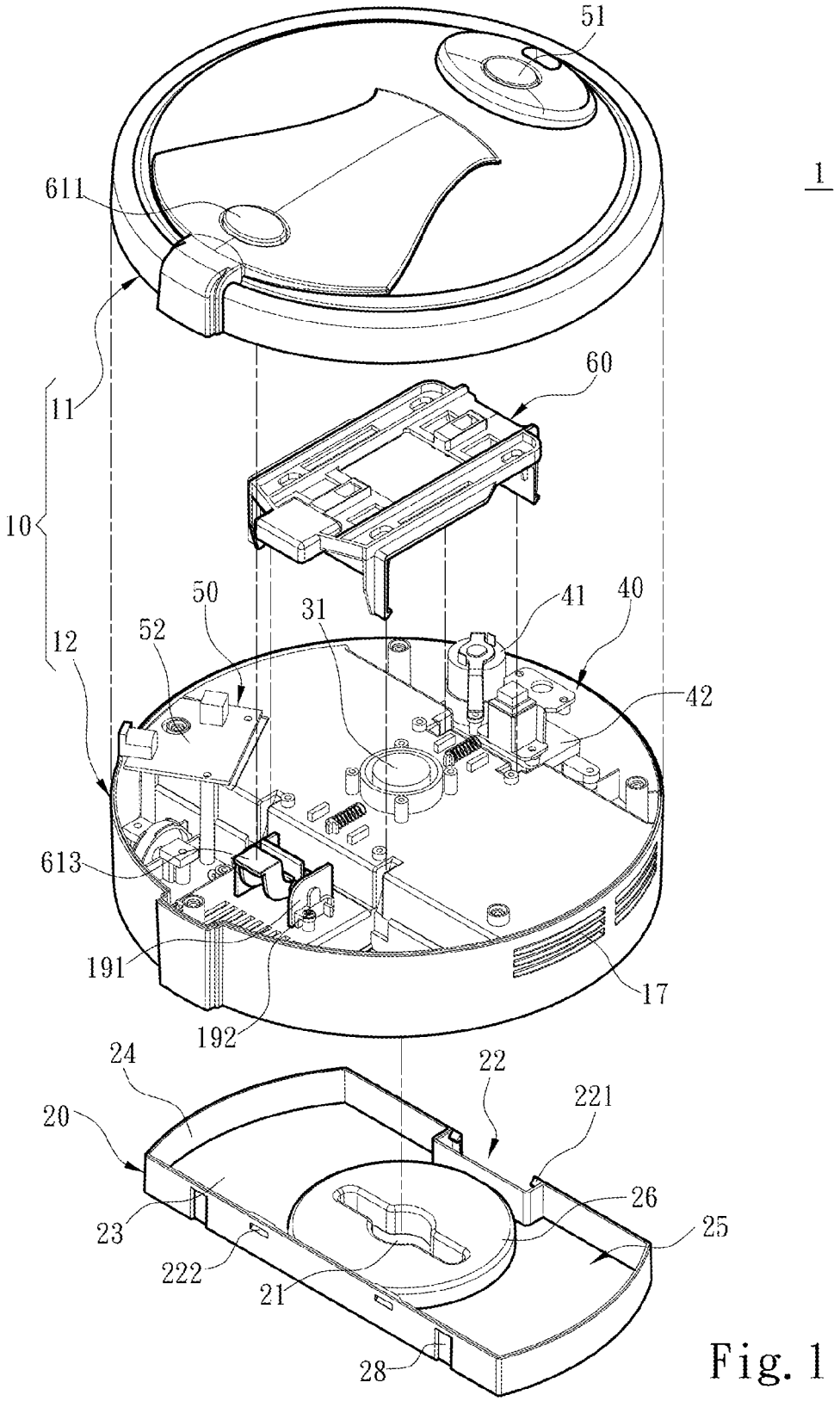
FIG. 1 is an exploded view of the self-moving dust suction apparatus of the invention.
Figure 2:
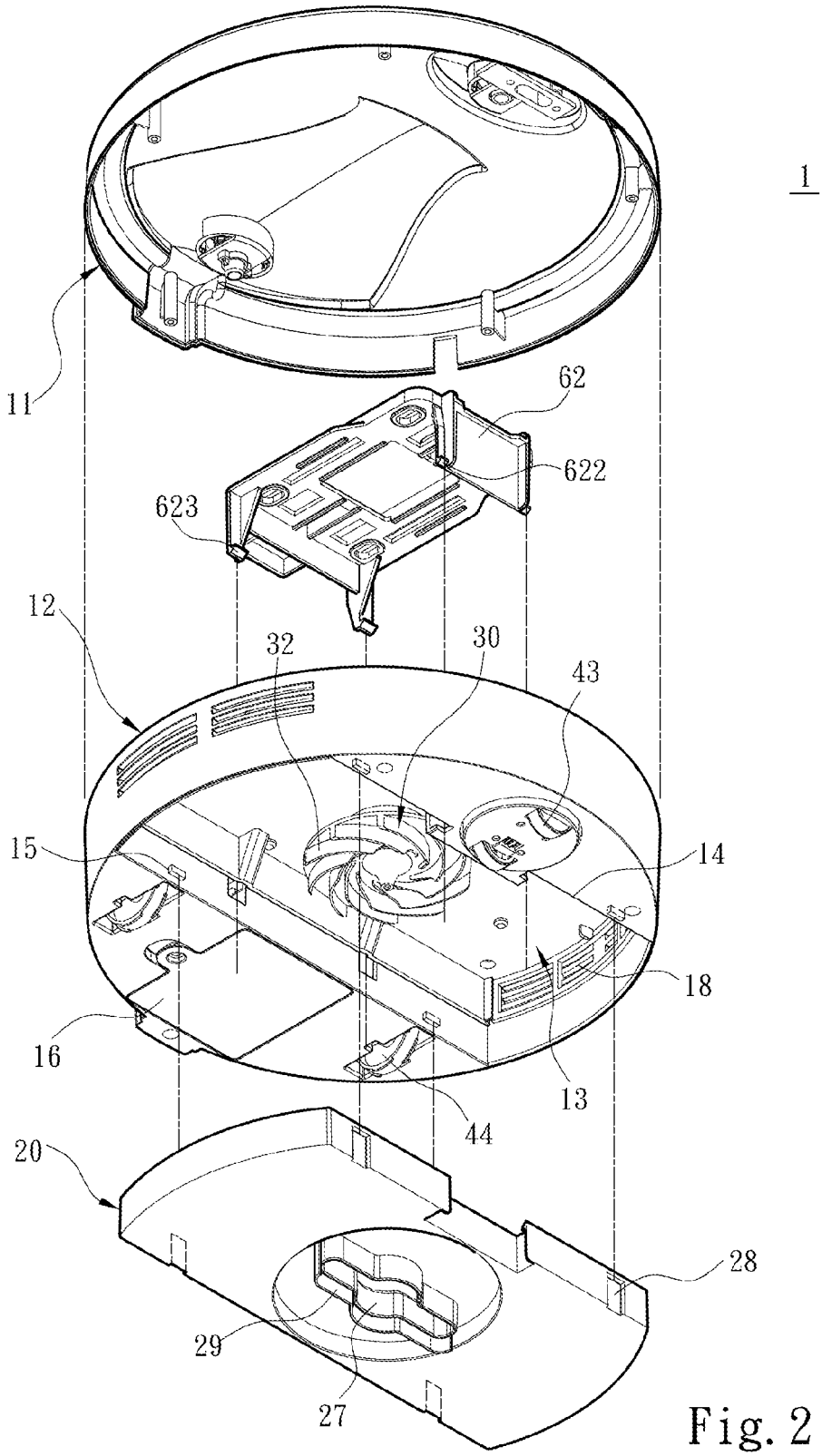
FIG. 2 is another exploded view of the self-moving dust suction apparatus of the invention.

Please referring to FIG. 1, the present invention aims to provide a self-moving dust suction apparatus 1 to facilitate cleaning that comprises a dust suction base 10 and a detachable dust collection unit 20 combined with the dust suction base 10. When the self-moving dust suction apparatus 1 is activated by a user the dust suction base 10 generates suction airflow to suck dirt and moves in a space to be swept. The sucked dirt is collected in the detachable dust collection unit 20. For instance, the dirt could include dust, scraps of paper, sands, hairs and any other articles that can be gathered by suction.

Please also referring to FIGS. 1 through 4, the dust suction base 10 includes an upper lid 11 and a base casing 12 connecting with the upper lid 11. The base casing 12 includes a housing space 13, an air drawing mechanism 30, a housing space 13 corresponding to the air drawing mechanism 30, an opening 14 communicating with the housing space 13, at least one fastening portion 15 located in the housing space 13, a driving wheel assembly 40 disposed on the dust suction base 10 to drive the dust suction base 10 to move along a dust suction direction, a control unit 50 electrically connecting to the air drawing mechanism 30 and driving wheel assembly 40, a power source assembly 16 electrically connecting to the control unit 50, at least one air outlet 17, at least one filter 18 corresponding to the air outlet 17 and a trigger driven mechanism 60. The air drawing mechanism 30 includes a first driving motor 31 and an air fan 32 driven by the first driving motor 31. The driving wheel assembly 40 includes a second driving motor 41, a transmission gear set 42 driven by the second driving motor 41, a driving wheel 43 driven by the transmission gear set 42 and an auxiliary driven wheel 44 hinged on the base casing 12. The control unit 50 includes an activation switch 51 to control activation of the self-moving dust suction apparatus 1 and a control circuit 52 electrically connecting to the activation switch 51. The power source assembly 16 provides DC power to the self-moving dust suction apparatus 1, and can be general batteries or charge batteries which is not the limitation in implementation. The power source assembly 16 can also be a power cord and a rectification module to rectify city power to DC power. More specifically, the control unit 50 is electrically connected to the air drawing mechanism 30 and the driving wheel assembly 40, and controls activation or shut down of them. The first driving motor 31 of the air drawing mechanism 30 receives the DC power from the power source assembly 16 to drive the air fan 32 to spin to generate the suction airflow. The second driving motor 41 of the driving wheel assembly 40 receives the DC power to drive the drive wheel 43 to rotate and move on a floor according to a preset movement mode. The air outlet 17 is disposed on the base casing 12 to discharge the suction airflow generated by the air drawing mechanism 30. The filter 18 corresponds to the air outlet 17 to filter the suction airflow and discharge clean airflow. The trigger driven mechanism 60 includes a trigger unit 61 depressible by the user, a latch element 62 driven by the trigger unit 61 and at least one first elastic element 63 to provide a resilient force to the latch element 62. The trigger unit 61 includes a button 611 located on the upper lid 11 and depressible by the user, a second elastic element 612 interposed between the upper lid 11 and the button 611 to support the button 611, and a fastening element 613 hinged on the base casing 12 and pressed by the button 611. The fastening element 613 includes a press portion 614, a hook portion 615 and a hinge portion 616 to bridge the press portion 614 and hook portion 615. The hinge portion 616 is hinged on the base casing 12 through a hinge pin 19. The base casing 12 includes an anchor portion 191 to hold the hinge pin 19 and a screw 192 to fasten the anchor portion 191 on the base casing 12. In this embodiment, the hinge portion 616 of the fastening element 613 is a hole, but this is not the limitation. In other embodiment the fastening element 613 can also be a pin to hinge in a hole. The latch element 62 includes a connecting portion 621 to latch on the hook portion 615, at least one first latch portion 622, at least one second latch portion 623 and at least one housing channel 624 between the first and second latch portions 622 and 623. The first latch portion 622 has a first abutting surface 625 and a first latch surface 626. The second latch portion 623 has a second abutting surface 627 and a second latch surface 628. In this embodiment the first abutting surface 625 and the second abutting surface 627 are respectively an inclined surface or a curved surface, but this is not the limitation of the invention. The first elastic element 63 is held in the housing channel 624, and two ends thereof abut the base casing 12 and the latch element 62 respectively. In this embodiment the first elastic element 63 is a spring, or is made of other elastic material, but this also is not the limitation of the invention.

The detachable dust collection unit 20 is located in the housing space 13 through the opening 14, and includes a dust suction inlet 21 corresponding to the air drawing mechanism 30, at least one first coupling portion 22, a holding surface 23, at least one holding wall 24 extended from the holding surface 23, a holding portion 25 surrounded by the holding surface 23 and holding wall 24, a protruding portion 26 jutting from the holding surface 23 towards the holding portion 25 to dispose the dust suction inlet 21, a guiding portion 27 extended from the protruding portion 26 to surround the dust suction inlet 21 and a second coupling portion 28 located on the holding wall 24. The first coupling portion 22 includes at least one first latch hook 221 and at least one second latch hook 222. The first latch hook 221 includes a third abutting surface 223 and a third latch surface 224. The second latch hook 222 includes a fourth latch surface 225. In this embodiment the third abutting surface 223 is, but not limited to, an inclined surface or a curved surface. In this embodiment the second coupling portion 28 is, but not limited to, a trough. The airflow directing element 29 is disposed on the detachable dust collection unit 20 to confine direction of the suction airflow passing through the dust suction inlet 21. In this embodiment, the airflow directing element 29 is an elastic barrier plate which partially surrounds the dust suction inlet 21 and extends towards the floor from the detachable dust collection unit 20 to confine the direction of the suction airflow flowing into the dust suction inlet 21. The elastic barrier plate partially surrounds one side of the dust suction inlet 21 opposite to the dust suction direction, and has a sway movement to sway away from the dust suction direction upon being in contact with an obstacle on the floor. In a prefer embodiment, the elastic barrier plate is spaced from the floor at a distance ranged between 0.5 mm and 10 mm, but this also is not the limitation of the invention.

Figure 3:
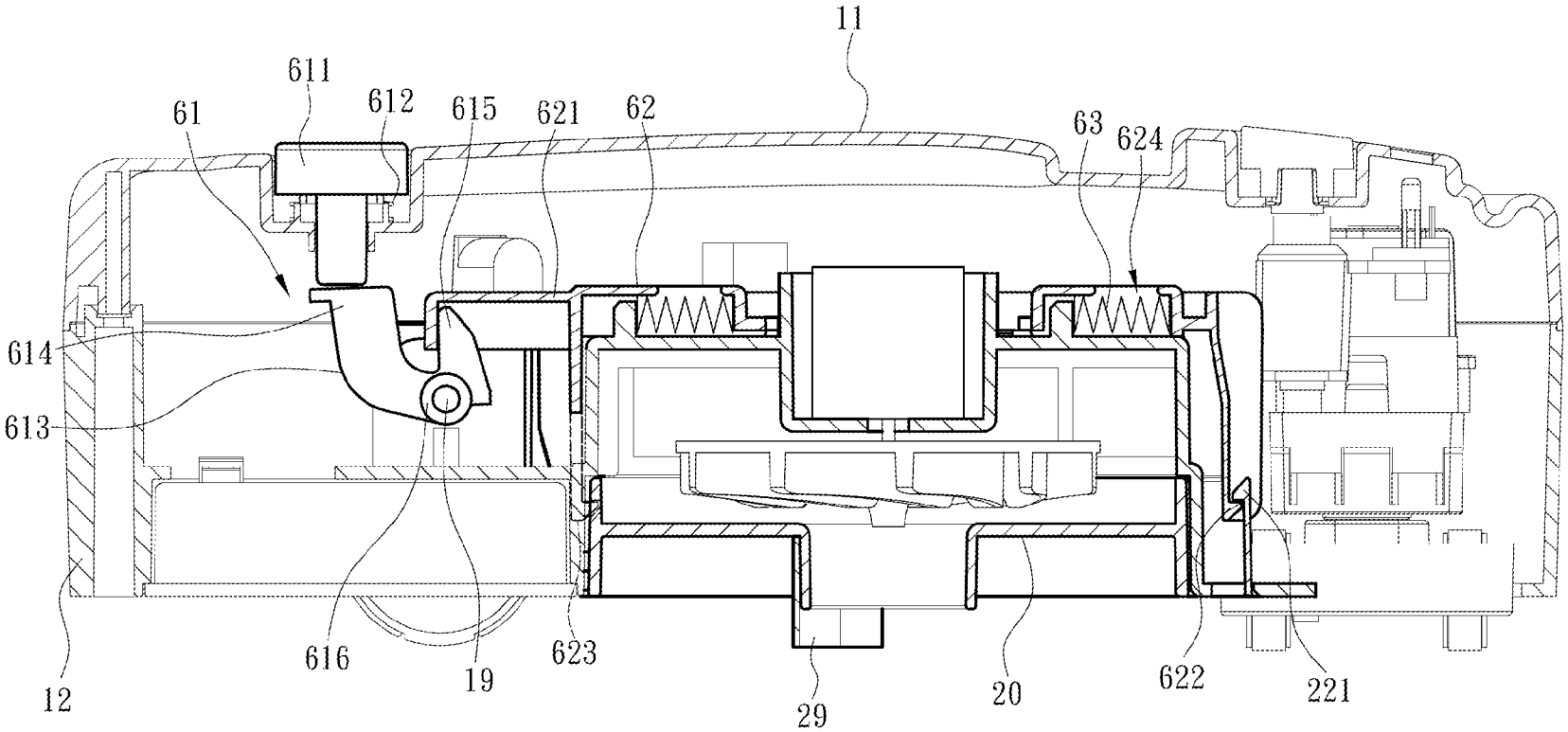
FIG. 3 is a sectional view of the self-moving dust suction apparatus of the invention in a coupling condition.
Figure 4:
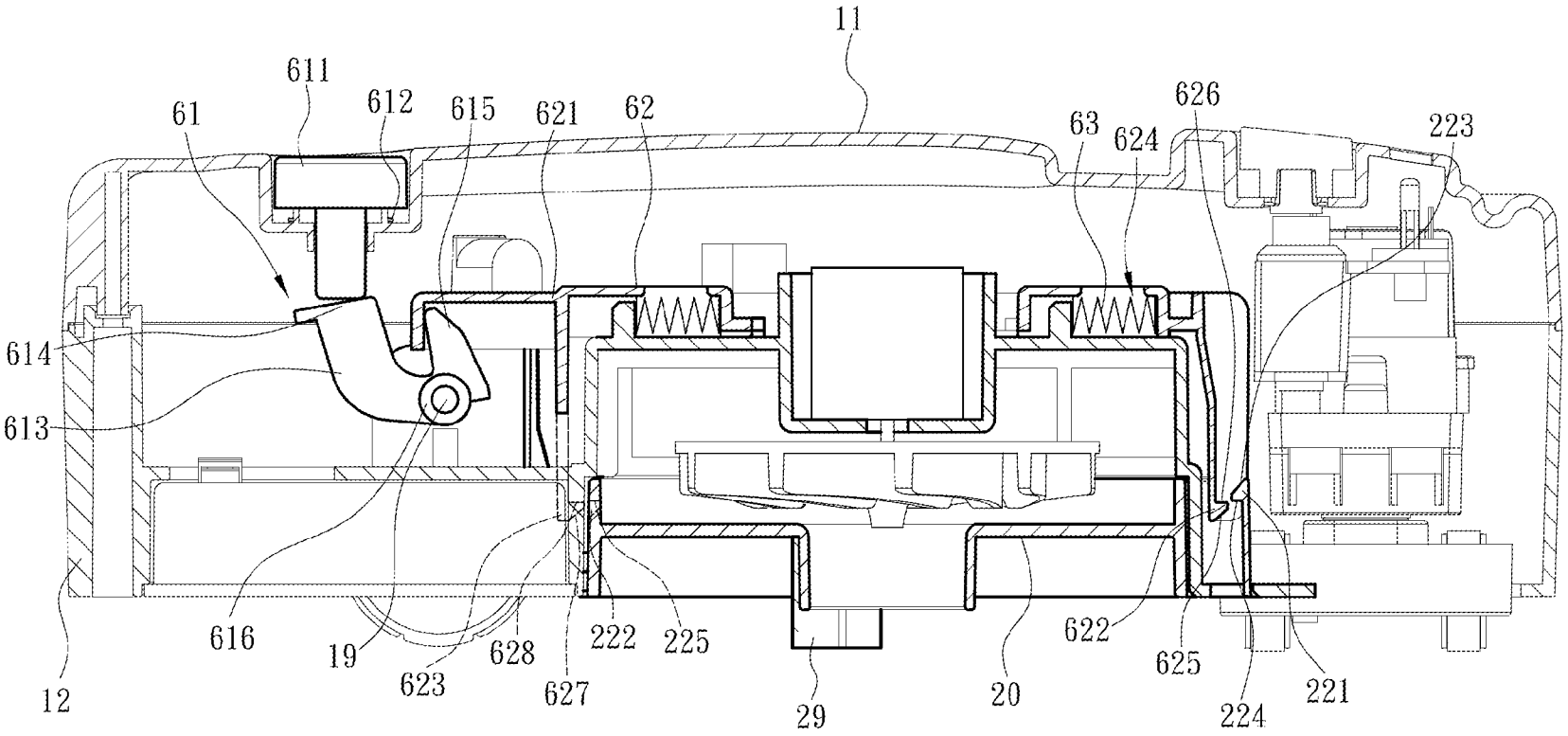
FIG. 4 is a sectional view of the invention showing the detachable dust collection unit in a first separation step condition.
Figure 5:
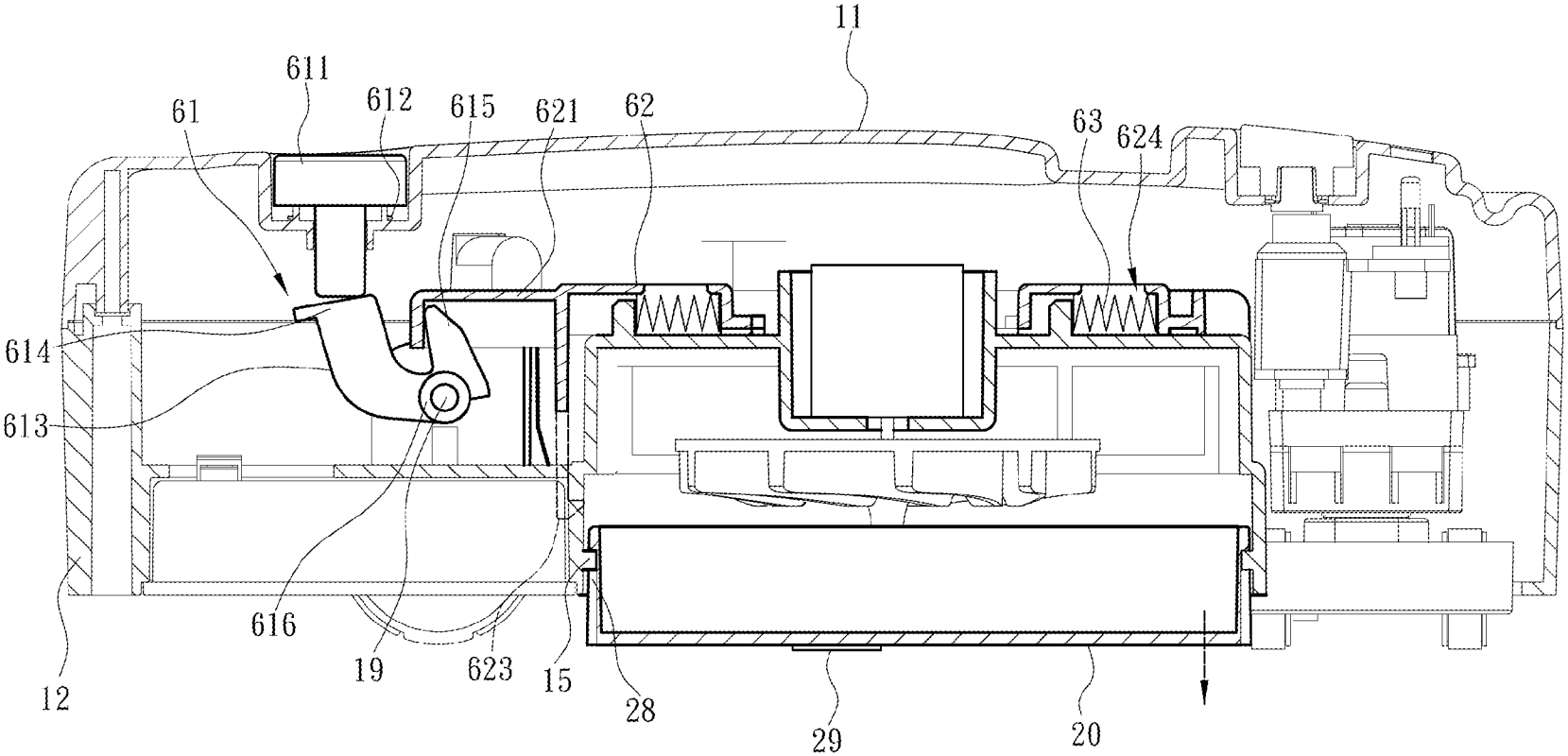
FIG. 5 is a sectional view of the invention showing the detachable dust collection unit in a second separation step condition.
Figure 6:
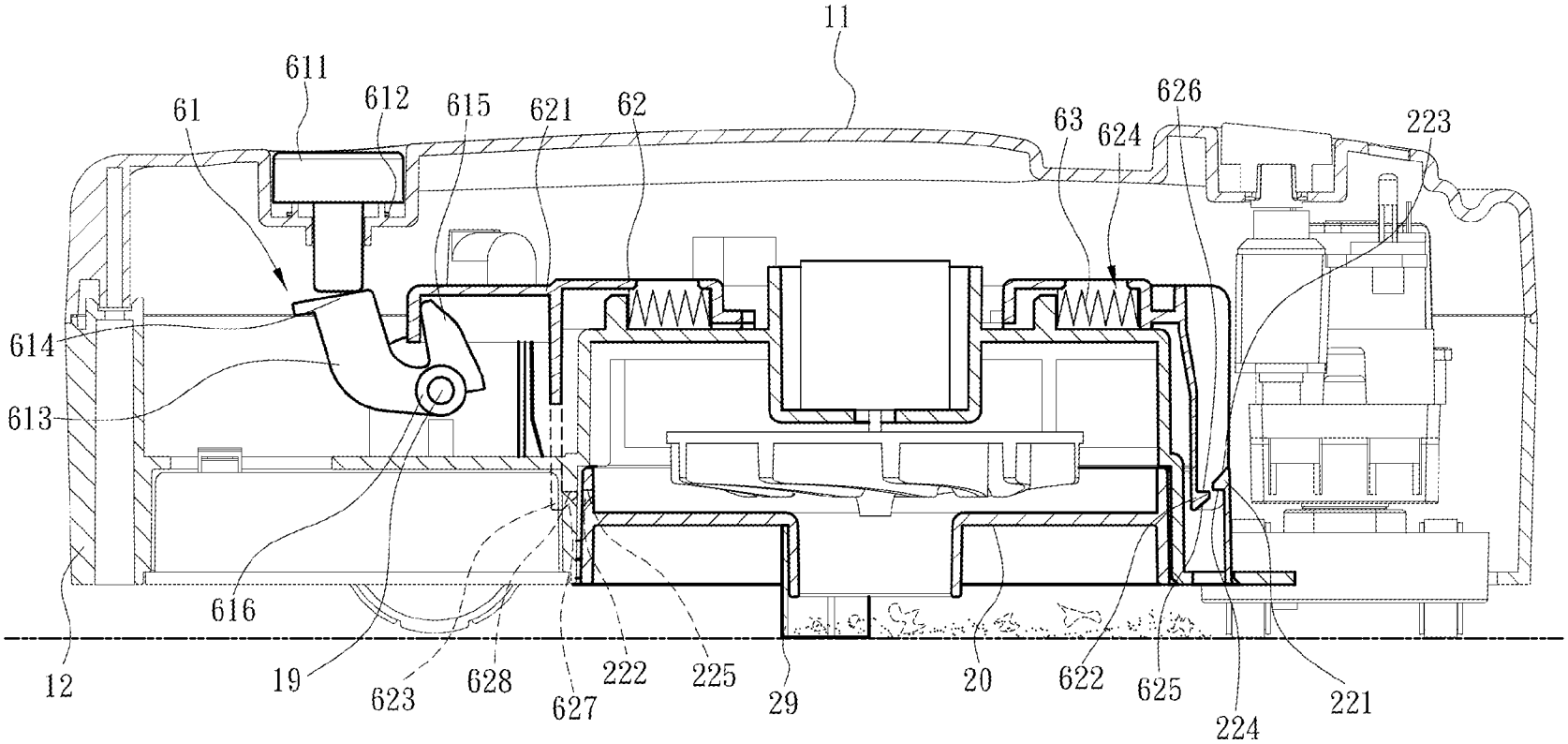
FIG. 6 is a sectional view of the invention showing airflow confined by the airflow directing element.

Please refer to FIGS. 3 through 5, in the present invention, the first elastic element 63 provides a resilient force to make the latch element 62 at a latch position in normal condition. At the latch position, the first latch portion 622 of the latch element 62 is latched on the first latch hook 221 of the detachable dust collection unit 20 and the second latch portion 623 is latched on the second latch hook 222, thus the latch element 62 can anchor the detachable dust collection unit 20. When the latch element 62 is moved to compress the first elastic element 63, it is at a release position. In the release position, the first latch portion 622 is disengaged from the first latch hook 221 and the second latch portion 623 is disengaged from the second latch hook 222, thus the detachable dust collection unit 20 can be removed from the base casing 12. When the latch element 62 is at the release position the detachable dust collection unit 20 can be removed from the base casing 12. Details for explaining operation of the present invention is discussed below. At first, the user puts the self-moving dust suction apparatus 1 on the floor and presses the activation switch 51, then the control unit 50 controls the air drawing mechanism 30 to generate the suction airflow and also controls the driving wheel assembly 40 to move on the floor according to the preset movement mode to perform cleaning operation. During the cleaning operation the dirt on the floor is sucked into the self-moving dust suction apparatus 1 via the suction airflow passing through the dust suction inlet 21. Referring to FIG. 6, when the self-moving dust suction apparatus 1 move according to the dust suction direction, areas where the dust suction inlet 21 has passed through is cleaned. Through the airflow directing element 29 the self-moving dust suction apparatus 1 is confined to clean other areas not yet been cleaned, namely areas in front of the dust suction inlet 21. Hence the dust suction power of the dust suction apparatus 1 can be enhanced since the dust suction scope is diminished. After the suction airflow passes through the filter 18 and the air outlet 17, the dirt carried by the suction airflow is filtered by the filter 18 and retained in the detachable dust collection unit 20. When the detachable dust collection unit 20 has accumulated a sufficient amount of the dirt, the user can press the button 611 to remove the detachable dust collection unit 20 and clear the dirt therein. More specifically, when the user depresses the button 611 the press portion 614 of the fastening element 613 also is depressed to make the fastening element 613 rotates, and the hook portion 615 thereof drives the connecting portion 621 to make the latch element 62 move from the latch position to the release position, thus the latch element 62 can disengage from the detachable dust collection unit 20. As such, a first stage separation step of the detachable dust collection unit 20 is finished. When the detachable dust collection unit 20 disengages and spaces from the latch element 62 for a distance, the base casing 12 holds the detachable dust collection unit 20. Namely, the fastening portion 15 of the base casing 12 supports and couples with the second coupling portion 28 of the detachable dust collection unit 20; then the user can easily remove the detachable dust collection unit 20 from the base casing 12 to finish the second stage separation step. Thus pollution caused by scattering of the dirt during unloading the detachable dust collection unit 20 that might occur can be avoided.

The aforesaid implementation process mainly elaborates the separation process of the detachable dust collection unit 20 and the dust suction base 10. On the other hand, when assembly of the detachable dust collection unit 20 and the dust suction base 10 is wanted, the user can merely align the detachable dust collection unit 20 with the opening 14 of the base casing 12 and insert the detachable dust collection unit 20 to the housing space 13 through the opening 14. During inserting, the fastening portion 15 of the base casing 12 first couples with the second coupling portion 28 of the detachable dust collection unit 20. Next, the first abutting surface 625 of the first latch portion 622 abuts the third abutting surface 223 of the first latch hook 221, and the second abutting surface 627 of the second latch portion 623 contacts with the holding wall 24 of the detachable dust collection unit 20, so as to make the latch element 62 move from the latch position to the release position. When the first abutting surface 625 is separated from the third abutting surface 223 and the second abutting surface 627 is separated from the holding wall 24, the latch element 62 is moved from the release position to the latch position, and the first latch surface 626 is coupled with the third latch surface 224, and the second latch surface 628 is coupled with the fourth latch surface 225. As such, assembly of the latch element 62 and the detachable dust collection unit 20 is finished.

As a conclusion, through the first stage separation step of the latch element and the detachable dust collection unit, and the second stage separation step of the fastening portion and the detachable dust collection unit, the invention can prevent the dirt from scattering during unloading of the detachable dust collection unit to avoid pollution. Moreover, through the airflow directing element, the direction of the suction airflow passing through the dust suction inlet can be confined, thereby to enhance dust suction power of the self-moving dust suction apparatus.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A self-moving dust suction apparatus to facilitate cleaning, comprising:

a dust suction base including an air drawing mechanism to draw airflow, a housing space corresponding to the air drawing mechanism, an opening communicating with the housing space and a trigger driven mechanism; the trigger driven mechanism including a trigger unit depressible by a user, a latch element driven by the trigger unit to situate at a latch position and a release position, and at least one first elastic element to provide a resilient force to make the latch element at the latch position in normal condition, wherein the trigger unit includes a button disposed on the dust suction base for a user to press and a fastening element hinged on the dust suction base and triggered by the button to switch the latch element between the latch position and the release position; wherein the latch element includes a connection portion to latch on the fastening element, at least one first latch portion and at least one second latch portion driven by the connecting portion, and at least one housing channel between the first latch portion and the second latch portion to disposed the first elastic element;

a detachable dust collection unit which is held in the housing space through the opening and includes a dust suction inlet corresponding to the air drawing mechanism and at least one first coupling portion coupled with the latch element at the latch position and separated from the latch element at the release position, the first coupling portion including at least one first latch hook coupled with the first latch portion and at least one second latch hook coupled with the second latch portion; and an airflow directing element which is disposed on the detachable dust collection unit and includes an elastic barrier plate partially surrounding the dust suction inlet and extending towards a floor from the detachable dust collection unit to confine direction of the airflow flowing into the dust suction inlet;

wherein while the latch element is at the latch position, the first latch portion is latched on the first latch hook and the second latch portion is latched on the second latch hook; while the first elastic element is compressed by the latch element, the latch element is at the release position, and the first latch portion is disengaged from the first latch hook and the second latch portion is disengaged from the second latch hook.

2. The self-moving dust suction apparatus of claim 1, wherein the dust suction base includes a driving wheel assembly to drive the dust suction base to move along a dust suction direction.

3. The self-moving dust suction apparatus of claim 2, wherein the dust suction base includes an auxiliary driven wheel driven by the driving wheel assembly.

4. The self-moving dust suction apparatus of claim 2, wherein the dust suction base includes a control unit electrically connected to the air drawing mechanism and the driving wheel assembly.

5. The self-moving dust suction apparatus of claim 1, wherein the elastic barrier plate partially surrounds one side of the dust suction inlet opposite to the dust suction direction.

6. The self-moving dust suction apparatus of claim 1, wherein the air drawing mechanism includes a first driving motor and an air fan driven by the first driving motor.

7. The self-moving dust suction apparatus of claim 1, wherein the detachable dust collection unit includes a holding surface, at least one holding wall extending from the holding surface and a holding portion surrounded by the holding surface and the holding wall.

8. The self-moving dust suction apparatus of claim 7, wherein the detachable dust collection unit includes a protruding portion jutting from the holding surface towards the holding portion to dispose the dust suction inlet and a guiding portion surrounding the dust suction inlet and extending from the protruding portion towards the floor.

9. The self-moving dust suction apparatus of claim 1, wherein the dust suction base includes a fastening portion, and the detachable dust collection unit includes a second coupling portion to couple with the fastening portion.

* * * * *